US005263441A

United States Patent [19]

Rembold et al.

[11] Patent Number: 5,263,441

[45] Date of Patent: Nov. 23, 1993

[54] HYDRAULIC VALVE CONTROL APPARATUS FOR INTERNAL COMBUSTION ENGINES

[75] Inventors: Helmut Rembold, Stuttgart; Ernst Linder, Mülacker, both of Fed. Rep. of Germany

[73] Assignee: Robert Bosch GmbH, Stuttgart, Fed. Rep. of Germany

[21] Appl. No.: 730,792

[22] PCT Filed: Oct. 26, 1990

[86] PCT No.: PCT/DE90/00817

§ 371 Date: Jul. 26, 1992

§ 102(e) Date: Jul. 26, 1992

[87] PCT Pub. No.: WO91/08385

PCT Pub. Date: Jun. 13, 1991

[30] Foreign Application Priority Data

Nov. 25, 1989 [DE] Fed. Rep. of Germany ..... 3939065

[51] Int. Cl.[5] ..... F01L 9/02; F01L 1/12; F02D 13/02

[52] U.S. Cl. ..... 123/90.12; 123/90.16

[58] Field of Search ..... 123/90.12, 90.13, 90.15, 123/90.16, 90.27, 90.48, 90.55, 90.57

[56] References Cited

U.S. PATENT DOCUMENTS

| | | | |
|---|---|---|---|
| 4,466,390 | 8/1984 | Babitzka et al. | 123/90.12 |
| 4,671,221 | 6/1987 | Geringer et al. | 123/90.16 |
| 4,674,451 | 6/1987 | Rembold et al. | 123/90.16 |
| 4,696,265 | 9/1987 | Nohira | 123/90.16 |
| 4,765,288 | 8/1988 | Linder et al. | 123/90.16 |
| 4,889,084 | 12/1989 | Rembold | 123/90.12 |
| 4,930,465 | 6/1990 | Wakeman et al. | 123/90.12 |

*Primary Examiner*—E. Rollins Cross
*Assistant Examiner*—Weilun Lo
*Attorney, Agent, or Firm*—Edwin E. Greigg; Ronald E. Greigg

[57] ABSTRACT

A hydraulic valve control apparatus in an embodiment for multi-cylinder internal combustion engine having a reservoir chamber, assigned to a pressure chamber of a valve tappet and having a reservoir piston that serves as a valve, with which the reservoir chamber can be separated from the pressure chamber. The reservoir piston is shifted out of its position of repose to a reservoir function by a hydraulic thrust that is conducted in the reservoir chamber under the control of a magnet valve, via a control line in which a check valve is disposed. Displacement of the reservoir piston occurs only whenever a valve actuation takes place via the drive cam and as a result the working pressure adequate for the displacement of the reservoir piston prevails in the pressure chamber.

26 Claims, 3 Drawing Sheets

HYDRAULIC VALVE CONTROL APPARATUS FOR INTERNAL COMBUSTION ENGINES

BACKGROUND OF THE INVENTION

The invention is based on a hydraulic valve control apparatus for an internal combustion engine as set forth herein after.

In a known hydraulic valve control apparatus of this type (German Offenlegungsschrift 3 511 820), the pressure line is controlled via a 3/2-way valve; in a special exemplary embodiment (FIGS. 8 and 9), the multi-position valve, in one switching position, connects the pressure line to the pressure chamber of a valve tappet, and in the other switching position connects it to the pressure chamber of a different valve tappet, using only a single liquid reservoir for both pressure chambers. Accordingly, for two engine inlet valves, one control position each of the magnet valve is used, and only one reservoir is used for both inlet valves. Especially at high rpm, the precision of control, or in other words how accurately the opening time cross section of the engine valve sought is attainable, depends on how large the total oil volume is that has to be shifted back and forth in control, and how many control conduits, with corresponding control cross sections, must be traversed. The magnet valve, especially, bears considerable responsibility for the expense and vulnerability to malfunction of this kind of hydraulic valve control apparatus; in engines having a typical maximum rpm, far from full utilization of the possible switching frequency of these magnet valves is made. A further factor is the burden due to the cost of every extra magnet valve.

In a hydraulic valve control apparatus of this type, it has also already been proposed (German Patent 38 15 668.7; U.S. Pat. No. 4,889,084) to embody the reservoir as a movable valve member; the end edge of the piston cooperates with a valve seat, so that the connection between the pressure line and reservoir chamber can be controlled. The reservoir piston simultaneously acts as an armature for a magnet valve that is open when without current, so that when the magnet is excited the pressure line is separated from the reservoir chamber. Although a combination of fluid reservoir and magnet valve, in which the same part serves as both the movable valve element of the magnet valve and as a reservoir piston, is attained by this provision, nevertheless one such "magnet valve reservoir unit" must be available for each valve control unit.

ADVANTAGES OF THE INVENTION

The valve control apparatus according to the invention has the advantage over the prior art that even a low determined control pressure from the control lines suffices to lift the reservoir piston from its valve seat. Since the control line is controlled by the magnet valve, opening of the magnet valve acts, in the feed line that is at low pilot pressure, as a pressure thrust of the control oil on the reservoir piston.

In an advantageous feature of the invention, a pressure face acting counter to the force of the reservoir spring and always acted upon by the pressure of the control oil present in the pressure conduit is provided on the reservoir piston; the force of the reservoir spring is greater than the control force plus the pilot pressure force effected by this pressure face. This reinforcing actuation force that engages the pressure face of the reservoir piston from the pressure chamber is then correspondingly strong if the associated valve tappet is just then being actuated by the drive cam, which as a result produces the high working pressure in the pressure chamber necessary for the actuation of the inlet valve. When a plurality of reservoir pistons are acted upon simultaneously by the control pressure, in this embodiment of the invention, the pressure thrust thus remains ineffective for all the reservoir pistons at which the drive cam of the engine valve is inoperative at that time as well. The control pressure, even with the pressure thrust, is not sufficient by itself to lift the reservoir piston from the valve seat. It is thus made possible in a very simple way for a plurality of control units to be acted upon by the control pressure simultaneously, yet nevertheless to lift from the seat only those reservoir pistons in which the valve tappet is also being actuated by the drive cam at that time. Since in this system the forces are balanced, even a slight control pressure is already sufficient, and so it is possible to work with simple low-pressure magnet valves. As soon as the reservoir piston has just lifted from its seat, then as in the basic embodiment set forth, its further displacement is effected by the high pressure from the pressure chamber, since the control oil now acts beyond the pressure face beyond the entire end face of the reservoir piston. However, the control pressure must be adjusted quite accurately in each case, so that the actual lifting of the reservoir piston from the seat is attained at the desired instant.

The bottom edge of the reservoir piston, which cooperates with a fixed seat, preferably serves here as the valve control edge of the reservoir valve, so that in the position of repose or outset position of the reservoir piston the pressure conduit is radially defined by the jacket face of the reservoir piston, while the reservoir chamber is defined by the end face of the reservoir piston. For this purpose, an annular groove may be formed around the jacket face, for instance in the vicinity of the seat, so that the hydraulic fluid, after the reservoir piston has lifted from the seat, can flow uniformly from all sides into the reservoir chamber. The pressure face on the reservoir piston is also preferably formed by a shoulder in its jacket face, so that the diameter of the valve seat is somewhat smaller than the diameter of the reservoir piston in its radially guided portion, with the resultant differential annular face forming the pressure face.

Instead of a seat control, a slide control for this reservoir valve may naturally be provided, in which case the pressure conduit is made to communicate with the reservoir chamber only after a predetermined minimum travel of the reservoir piston has been executed.

In an advantageous feature of the invention, a relief line branches off from the reservoir chamber and contains a backup throttle and possibly a pressure holding valve. The relief line is preferably disposed in the bottom of the reservoir piston and connects the reservoir chamber to the reservoir spring chamber, so that quantities of fluid flowing out via the pressure holding valve can flow into the fundamentally pressure-relieved reservoir spring chamber and from there into the oil tank. This pressure holding valve additionally increases the switching precision, because it makes a more exactly definable control pressure attainable in the reservoir chamber.

In another advantageous feature of the invention, a pilot pressure reservoir is connected to the feed line upstream of the magnet valve. By means of this pilot pressure reservoir, an additional precision and maintenance of the control pressure are attained, because at the moment when the magnet valve opens, despite the rapid outflow of some of the fluid toward the reservoir or control chamber, this pressure of the pilot pressure reservoir is propagated and there effects a defined pressure thrust.

In another advantageous feature of the invention, the magnet valve is embodied as a 2/2-way valve, which has the advantage of a high switching frequency and operational reliability, at a low production cost.

In another advantageous embodiment of the invention, the force of the reservoir spring is less than the opening force engaging the reservoir piston, which force includes the control pressure applied onto the reservoir piston bottom; the control pressure set by the pressure holding valve may optionally be lower than the low pressure of the fluid source, and the fill line is controlled by the reservoir piston; the fill line is blocked after the connection between the pressure conduit and reservoir chamber is established, and is reopened in the outset position of the reservoir piston.

In a further feature of the invention, this control may be such that on the jacket face of the reservoir piston there is a longitudinal groove that coincides constantly with an annular groove present in a bore receiving the reservoir piston and which in the position of repose or outset position of the reservoir piston communicates with the pressure conduit, but is separated from the pressure conduit after the reservoir piston is displaced out of its outset position counter to the force of the reservoir spring. Naturally, instead of one longitudinal groove, a plurality of such longitudinal grooves, or one annular groove may be disposed on the jacket face of the reservoir piston. The definitive feature is that the connection between the filling line and the pressure conduit is interrupted after the reservoir piston lifts from its seat.

In another advantageous feature of the invention, the feed line upstream of the magnet valve communicates with the pressure conduit via a filling line, and in the filling line there is a check valve opening in the direction of the pressure conduit. As a result, leakage losses that ensue during operation are compensated for and moreover a constant pilot pressure in the pressure conduit or pressure chamber is established, in order to make the balance of forces still more precise.

In another advantageous feature of the invention, for which independent protection is claimed and which relates to the use of the invention only in multi-cylinder internal combustion engines, the various valve control units (magnet valves) are each controllable via the electronic control unit up to only a drive of 180° of camshaft rotation angle, so that a plurality of valve control units are controlled by only one magnet valve, and overlapping of control times, that is, ON times of the magnet valve, above a rotation of 180° per valve are precluded. Downstream of the magnet valve, the control line branches off to the various control units. The actuation time segments of these control units accordingly have no overlapping above 180° of crankshaft rotation angle, from the beginning of the opening process of the particular control unit. A particular feature of hydraulic valve control devices is exploited here, which is that with increasing rpm the final closing time shifts to later with reference to the ongoing rotational angle of the crankshaft. This delay in the closing process is associated with the mass acceleration forces, which increase with increasing rpm, and with decreasing control time segments while the closing speed (determined by spring force) remains the same, in the course of which the average pressure level in the pressure chamber of the tappet drops. At high rpm, the closing speed is approximately equivalent to the cam speed. Additionally, at high rpm the inlet closure of the engine valve is designed such that it is reached approximately after a crank shaft rotation of from 60° to 80° after bottom dead center, or in other words after the turning point of the drive cam path. Maximum power at high rpm is attained as a result. An increase in power is no longer attainable then via the engine valve control. The situation is different at low engine rpm, at which for instance with inlet closure around 180° of camshaft rotation, a control of power is attainable by shifting the final closure of the engine valve to as early a time as possible. In this case, however, at average and low rpm, in the range greater than 180 of camshaft rotation, there is no further high pressure effected by the valve closing springs in the pressure chamber or pressure conduit. It is assumed here that bottom dead center, in other words the turning point of the drive cam path, is located at 120 of camshaft rotation. The earlier the engine valve is intended to close, or in other words the earlier the reservoir valve is opened, the less these effects of the closing forces are, so that for intelligent control, advantageously all the control units are controllable via a valve control apparatus according to the invention, via only one magnet valve; there are no time overlaps between the valve strokes in these first 180 of camshaft rotation.

In a further advantageous feature of the invention, groups of valve control units are controllable independently, after a first division of the control line downstream of the magnet valve, by means of at least one preselection valve. This can be employed particularly advantageously in engines having relatively large inlet closure angles.

In another advantageous feature of the invention, the preselection valve is embodied as a 2/2-way valve, in which case correspondingly a plurality of such preselection valves are connected in parallel.

In another advantageous feature of the invention, the preselection valve is embodied as a 3/2-way valve, and via one 3/2-way valve in combination with the control valve, two pressure chambers at a time can be controlled.

Further advantages and advantageous features of the invention will become apparent from the ensuing description, the drawing and the claims.

DESCRIPTION OF THE EXEMPLARY EMBODIMENT

Figure 1:
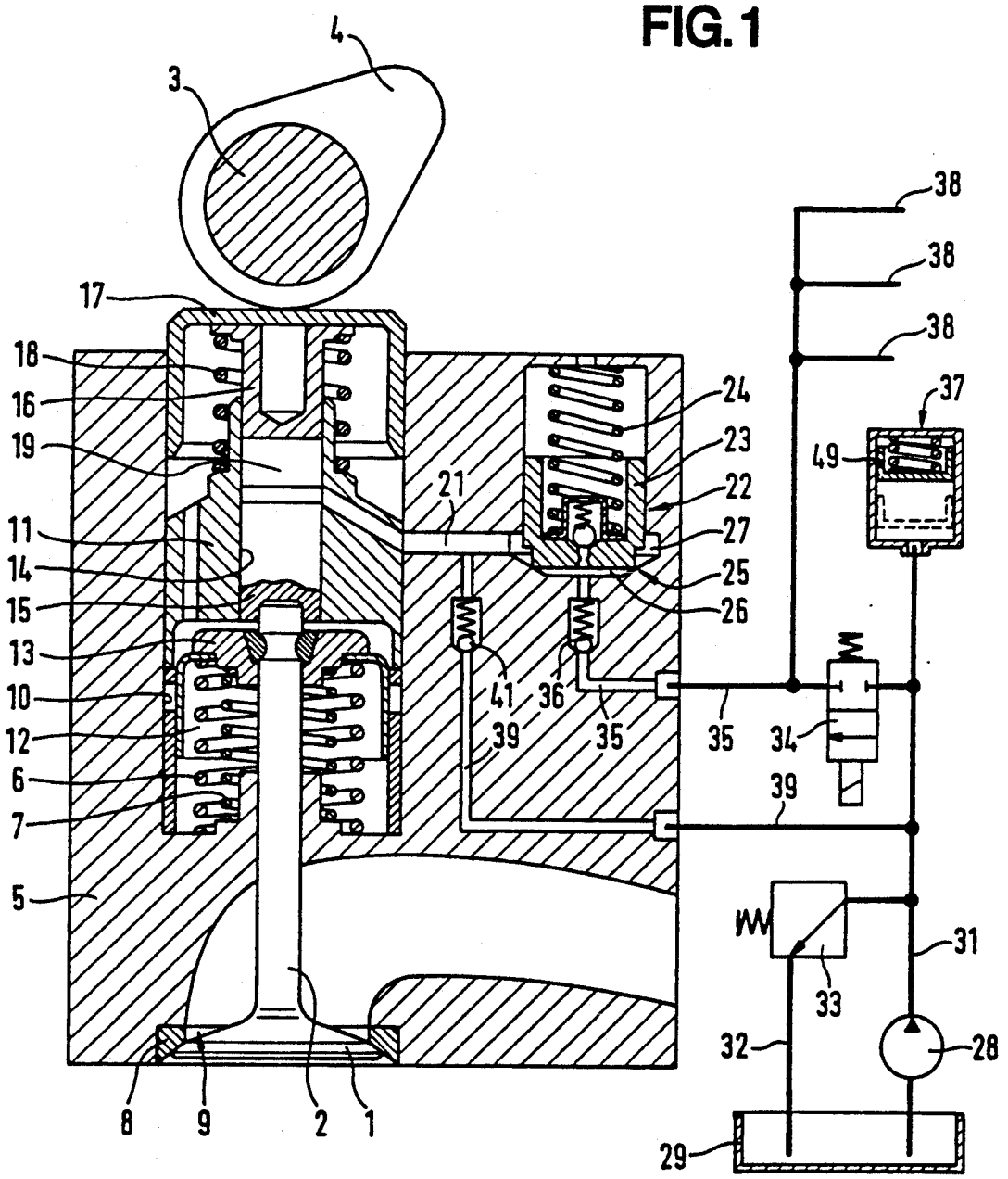
FIG. 1 is a longitudinal section through the valve control apparatus of an engine inlet valve, with the associated hydraulic circuit diagram.

FIG. 1 shows a hydraulic valve control apparatus according to the invention in both longitudinal section and in the form of a hydraulic circuit diagram. It is disposed between a valve shaft 2 carrying a valve plate and a drive cam 4 revolving with a camshaft 3. The valve shaft 2 is axially displaceable guided in a valve housing 5 and is urged in the closing direction of the valve by valve closing springs 6 and 7, as a result of which the valve plate 1 is pressed against a valve seat 8 and the valve housing 5. The valve plate 1 controls a valve inlet opening 9 formed between it and the valve seat 8 when the valve opens.

The hydraulic valve control apparatus has a control housing 11, inserted into a housing bore 10 of the engine valve housing 5; disposed in the control housing 11 is a spring chamber 12, and the valve closing springs 6 and 7 are accommodated coaxially with one another in the spring chamber 12. A cup-shaped spring plate 13 that is anchored by and axially displaceable with the valve shaft 2 and loaded by the valve closing springs 6 and 7 is inserted into the control housing 11 from below. A valve piston 15 cooperating form-fittingly with the valve shaft 2 of the inlet valve is disposed in a central, axially continuous bore 14 of the control housing 11, and a work piston 16 of a cam piston 17 is disposed axially displaceably above the valve piston 15. The work piston 16 is loaded by a restoring spring 18, which on one end is supported on the shoulder of the control housing 11 and on the other end engages a flange of the work piston 16 and thereby presses the cam piston 17 against the valve control cam 4.

An oil-filled pressure chamber 19 is enclosed between the end faces, facing one another, of the valve piston 15 and work piston 16 in the housing bore 14; the effective length of the entire valve tappet is determined by the quantity of oil present in this pressure chamber 19. If there is a reduction in the enclosed quantity of oil, the effective opening stroke of the inlet valve is shorter; if the maximum filling is maintained in force, the stroke of the inlet valve is maximal.

The pressure chamber 19 communicates via a pressure conduit 21 with a reservoir valve 22, which has a radially sealing cup-shaped piston 23 that in its position of repose shown, loaded by a restoring spring 24, rests on a valve seat 25. The lower end face of the reservoir piston 23 defines a reservoir chamber 26, while part of the jacket face of the reservoir piston 23 demarcates an annular conduit 27 surrounding the reservoir piston, in which annular conduit the pressure conduit 21 discharges.

The valve control apparatus operates with a hydraulic circuit, with a feed pump 28 that aspirates the control oil from an oil tank 29 and delivers it to the valve control apparatus via a feed line 31. To attain a particular feed pressure, a pressure control valve 33 is disposed in a line 32 that branches off from the feed line 31 and leads back to the oil tank 29.

The feed line 31 leads to a 2/2-way magnet valve 34, which controls a control line 35 that leads to the reservoir chamber 26 via a spring-loaded, one-way check valve 36. Connected to the feed line 31 just upstream of the magnet valve 34 is a pilot pressure reservoir 37, the reservoir pressure of which is adapted with the pressure control valve 33, and which in the closing position of the magnet valve 34 shown is largely filled with control oil. Further control lines 38 branch off from the control line 35 and lead to other engine control valve units of the same engine; these units are embodied as equivalent to those shown.

Branching off from the feed line 31 is a filling line 39, which leads to the pressure conduit 21 and in which a spring-loaded, one-way check valve 41 opening toward the pressure conduit 21 is disposed.

Figure 2:
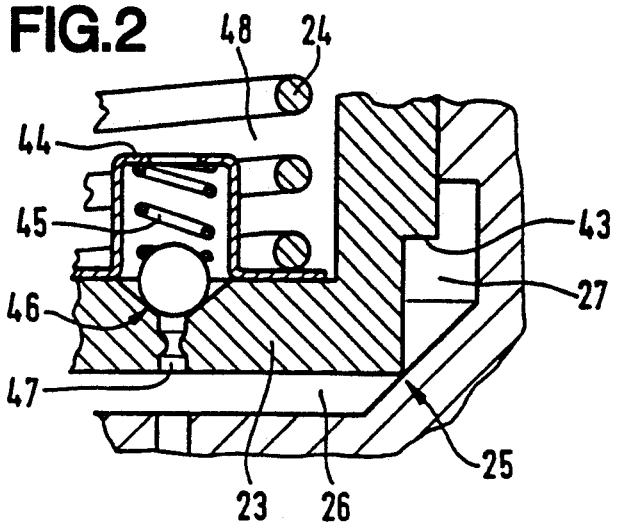
FIG. 2 shows a detail of FIG. 1 on a larger scale.

The reservoir valve 22 is shown on a larger scale in FIG. 2. In the region of the annular conduit 27, the reservoir piston has a shoulder on its jacket face, by means of which a pressure shoulder 43 acting in the opening direction of this valve is created. Correspondingly, the diameter of the valve seat 25 is less than the diameter of the reservoir piston 23 in its radial guide region.

By means of the reservoir spring 24, inside the cup-shaped reservoir piston 23, a spring plate 44 of a weak spring 45 is fastened to the reservoir piston bottom; the spring 45 loads the movable valve element of a one way relief valve 46 that is disposed in a relief line 47 that connects the reservoir chamber 26 to the reservoir spring chamber 48. The relief line 47 is embodied here as a throttle line, so that it acts as a backup throttle for an outflow of control oil from the reservoir chamber 26 to the reservoir spring chamber 48. The relief valve 46 can additionally be embodied as a pressure control valve, so as to maintain a predetermined pilot pressure in the reservoir chamber 26.

The valve control apparatus described in FIGS. 1 and 2 functions as follows: Upon rotation of the camshaft 3, the cam piston 17 and work piston 16 are displaced downward via the drive cam 4, counter to the restoring spring 18, and positively displaces the hydraulic oil downward in the pressure chamber 19. The resultant pressure is propagated on the one hand toward the reservoir valve 22 via the pressure conduit 21, but on the other acts upon the upper end face of the valve piston 15, which together with the valve shaft 2 and valve plate 1 is displaced downward counter to the force of the valve closing springs 6 and 7; the valve plate 1 lifts from the valve seat 8 and uncovers the inlet opening 9, so that combustion fluid flows into the engine combustion chamber in accordance with the uncovered cross section and with the opening time available, in other words the opening time cross section. The opening of the inlet valve is effected in synchronism with the intake strokes of the engine piston, and the various engine valves are opened successively in turn, in a manner adapted to the ignition sequence or crank drive of the engine; for instance, if the engine cylinders disposed side by side are numbered I–IV, the opening or ignition sequence may be III, IV, II and finally I, after which the engine valve of cylinder III would then open, for this kind of 4-cylinder engine, and so forth.

The relatively high pressure present from the pressure chamber 19 during operation of the opening valve is transmitted via the pressure conduit 21 into the annular conduit 27 of the reservoir valve 22, where it acts upon the pressure shoulder 43 on the reservoir piston 23 counter to the force of the reservoir spring 24. The force developed as a result of the area of the pressure shoulder 43 and the pressure in the annular conduit 27 is always less, however, than the force of the reservoir spring 24, and so the reservoir piston 23 remains on the valve seat 25. As long as the magnet valve 34 assumes the closing position shown and the reservoir piston 23 remains on its seat 25, the valve plate 1 executes a maximum opening stroke, since the hydraulic oil positively displaced by the work piston 16, lacking any possibility of deflection, displaces the valve piston 15 as far downward as the work piston 16 is displaced; the travel covered in this process is directly equivalent to the height of the drive cam 4.

In the drawing, the engine valve control is shown in a break in operation, in other words in a work position in which the base circle of the cam 4 cooperates with the cam piston 17, and the valve plate 1 of the inlet valve rests sealingly on its valve seat 8, driven by the valve closing springs 6 and 7. Any leakage losses of hydraulic oil in the pressure chamber 19 occurring during operation are compensated for via the filling line 39, by way of which hydraulic oil can flow at feed pressure via the check valve 41 into the pressure conduit 21 and thus into the pressure chamber 19. As a result, a pilot pressure that is always the same during the breaks in operation is generated in the pressure chamber 19, and voids that could lead to control errors in terms of the opening time and the opening stroke of the engine valve are also avoided.

As soon as the magnet valve 34 is switched over, the feed pressure prevailing in the pilot pressure reservoir 37 is transmitted from the feed line 31 via the control line 35 and the check valve 36 to the reservoir chamber 26, so that the lower end face of the reservoir piston 23 is acted upon by a control pressure that is only slightly less than the feed pressure in the feed line 31. With respect to the end face acted upon, this control pressure generates a force acting on the reservoir piston in the opening direction that is less than the force of the reservoir spring 24. Even if the pilot pressure force that originates at the annular shoulder 43 of the reservoir piston 23 and is always present as long as the constant pilot pressure prevails in the pressure chamber 19 is added to this control force, this combined force is inadequate to overcome the force of the reservoir spring 24. Only once the drive cam 4 becomes operative and actuates the work piston 16, creating a relatively high work pressure in the pressure chamber 19 as a result of which the force engaging the piston 23 because of the shoulder 43 rises accordingly, is the force of the reservoir spring 24 overcome and the reservoir piston 23 is displaced upward; it lifts out of its position of repose away from the valve seat 25, so that the hydraulic oil can flow from the pressure chamber 19 via the pressure conduit 21 into the reservoir chamber 26; after the reservoir piston 23 has lifted from the valve seat 25, the working pressure of the hydraulic oil acts upon the entire lower end face, thus effecting a high adjusting force that overcomes the force of the reservoir spring 24. It is accordingly a prerequisite that the drive cam 4 be operative, or in other words that an opening of the engine valve be taking place, if the reservoir piston 23 is to be displaced. However, because some of the positively-displaced quantity flows from the pressure chamber 19 to the reservoir chamber 26, the opening stroke of the engine valve is shortened accordingly, which also shortens the opening time cross section. This kind of change in the opening time cross section has an effect on the aspirated air volume of the engine and thus directly affects the rpm of the engine. To assure a certain opening of the engine valve in every case, the magnet valve 34 is reversed only whenever the opening stroke of the engine valve has already begun, or in other words whenever as a result of the drive cam 4 a displacement of the work piston 16 has already begun.

Simultaneously with the control line 35, the control lines 38 are also supplied with hydraulic oil at control pressure, so that besides the reservoir piston 23 shown, a number of reservoir pistons belonging to other engine valve controls of the same engine are also acted upon by hydraulic oil under control pressure. The reservoir 37, the reservoir volume of which is designed accordingly, is used so that an adequate control pressure is maintained in all the control lines in the event of this switchover of the magnet valve 30. While the reservoir fills in the time during which the magnet valve 34 is closed, so that its pilot pressure reservoir piston 49 assumes the position shown, this pilot pressure reservoir piston is displaced further upward with the magnet valve 34 opened, for instance to the position shown in dashed lines. As a result, the maximum capacity of the feed pump 28 can be kept correspondingly lower, and a high pumping quantity is also made available for a short time, so that a kind of pressure thrust upon the particular reservoir piston 23 acted upon takes place. As described above, the forces of the control pressure, pilot pressure and springs that then engage the system are adapted to one another such that only those reservoir pistons 23 that are additionally acted upon by working pressure on their pressure shoulder 43 lift from their seat 25; this working pressure can occur only if the drive cam 4 is acting upon the work piston 16. Thus, via the filling line 39 in the pressure conduit 21, a constant pilot pressure is generated in the breaks in operation in which the drive cam is not operative, and via the relief valve 46 in combination with its spring 45, an adequate filling pressure is maintained in the reservoir chamber 26. As soon as hydraulic oil flows at control pressure into the reservoir chamber 26 via the control line 35, after opening of the magnet valve 34, the control pressure is established in this reservoir chamber 26 as well, but this pressure is higher than the opening pressure of the relief valve 46, so that that valve opens. Since the relief line 47 in the reservoir piston bottom is embodied as a throttle line, this creates a backup, so that the control pressure can be maintained in the reservoir chamber 26. In each case, the pumping capacity of the feed pump 28 is greater than the quantity of hydraulic oil flowing out via all the simultaneously connected reservoir chambers 26 and their relief lines 27. As soon as the working pressure of the pressure conduit 21 additionally engages the pressure shoulder 43 of the reservoir piston 23, this reservoir piston 23 lifts up from its seat 25, and the check valve 36 is blocked by the working pressure, which is much higher than the control pressure in the control line 35.

Once it has been acted upon by the working pressure from the pressure conduit, the reservoir piston 23 is displaced counter to the force of the reservoir spring 24. From the instant at which the reservoir chamber 26 is opened toward the pressure conduit 21, the hydraulic oil positively displaced at working pressure by the work piston 16 is positively displaced into this reservoir chamber 26, so that the inlet valve begins to close again, in the course of which the valve shaft 2 with the valve piston 15 is displaced upward, and despite the continued pumping action of the work piston 16 pumps hydraulic oil out of the pressure chamber 19 into the reservoir chamber 26. As a result, the opening stroke of the valve plate 1 is shortened, and thus the opening time cross section of this inlet valve is shortened as well; the opening time cross section is determined not only by the stroke but also by the rpm. During this closing process of the valve plate 1, a certain quantity of oil flows out via the relief line 47 and the relief valve 46, but this quantity is extremely slight, and thus given that this kind of outflow quantity has been taken into account beforehand has no disadvantageous effect on the control.

As soon as the drive cam 4, with its return edge, becomes operative and the work piston 16 has moved upward again, then as soon as the valve plate 1 also again rests on the valve seat 8 the reservoir piston 23 can begin its return stroke, in which it pumps the hydraulic oil previously received back into the now-enlarging pressure chamber 19. This return pumping takes place even if the magnet valve 34 is still open, because the positive displacement pressure of the reservoir piston 23, effected by the reservoir spring 24, is far higher than the control pressure derived from the feed line 31. Not until the reservoir piston 23 rests on its seat 25 can a flow via the control line 35 through the reservoir chamber 26, via the check valve 36 and the relief valve 46, take place without having any influence on the control. The advantage, however, is that the instant of opening of the magnet valve 34 initiates the closure of the engine valve; this further closing motion of the engine valve effected by the valve closing springs 6 and 7—aside from the pressures in the combustion chamber itself, which act upon the valve plate 1—is determined by the deflection speed of the reservoir piston 23.

Figure 3A:
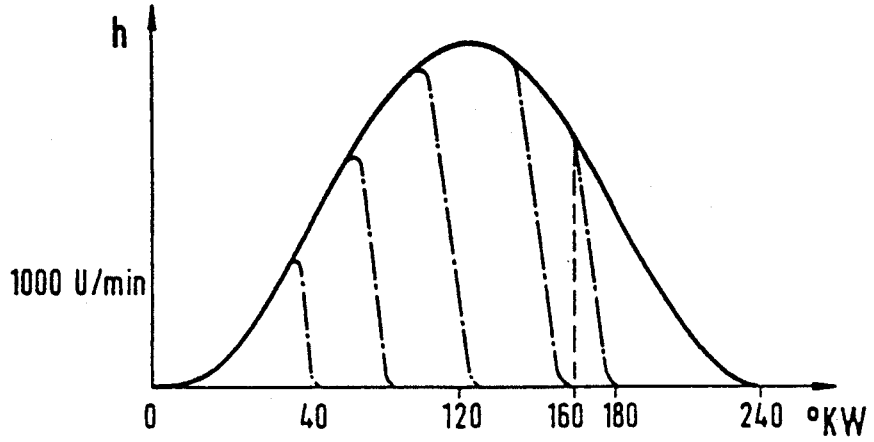
FIGS. 3*a, b, c,* shows three control diagrams, one above the other, of the opening movement of the valve.
Figure 3B:
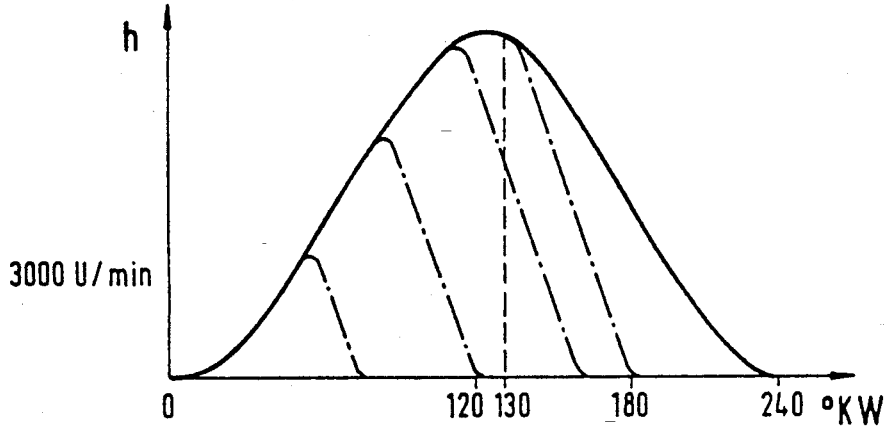
Figure 3C:
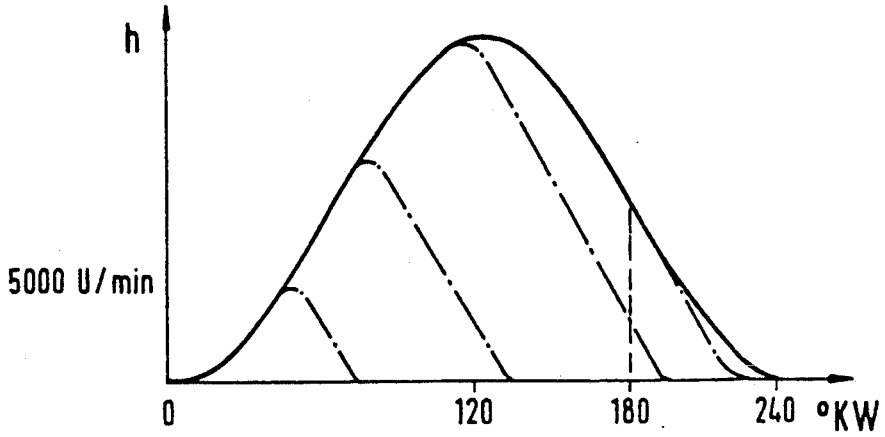

In FIG. 3, in terms of three diagrams one above the other, the working stroke course of the valve for three different engine speeds is shown. In the diagrams, the stroke of the engine valve h is plotted on the ordinate, and the degree of crankshaft rotational angle is plotted in °KW on the abscissa. The first diagram a is intended for an engine speed of 1000 rpm; the second diagram b corresponds to a speed of 3000 rpm, and the lowermost diagram c applies to a speed of 5000 rpm. The outer envelope curve in all three diagrams corresponds to the opening and closing process of the inlet valve without influence on the control via the magnet valve 34. The family of curves shown in dot-dash lines in each diagram corresponds in turn to a shortening of the opening stroke or opening time by the action of the magnet valve 34, in other words as a result of the opening thereof and of the reservoir valve 22 becoming operative. While the course of the opening portion of the curves is the same for all curves, the closing course varies. The opening portion of the curve is determined solely by the drive cam 4, which always has the same opening effect upon the engine valve. This is also true for the closing action corresponding to the return path of the drive cam 4. As soon as the magnet valve 34 has opened, however, the portion of the curve corresponding to closure of the engine valve is determined by the influences described above, and above all by the action of the reservoir piston 23.

A comparison of the three diagrams shows that the higher the engine speed, the flatter is the course of these closure curves shown in dot-dashed lines. The higher speed, the more the slope of the dot-dashed closing curves approaches the slope of the envelope curve the course of which is determined by the drive cam. This effect is based on the fact that as a result of the increase in mass forces with increasing rpm, the medium pressure level in the pressure chamber 19 drops, so that the compensation motion of the reservoir piston 23 proceeds more slowly. This property of this type of hydraulic engine valve control does not have an inconsiderable influence on the actual opening time cross section of the inlet valve. The envelope curve shown in solid lines in the diagrams, which corresponds in its course to that of the drive cam 4, is adapted for maximum output at high engine speed.

As can be seen from diagram 3 c, a valve control executed via the magnet valve 34 at 180 rotation of the camshaft is no longer adequate, because at these high speeds the inlet closure would coincide with the closure at 240 rotation of the camshaft, as happens in any case if there is no control. In other words, at maximum speed and full load, that is, in pumping after a maximum time cross section from 180 rotation of the camshaft on, electric control of the engine valve via the magnet valve 34 is unimportant and accordingly not necessary. Time cross section controls at maximum rpm and at lower load or power are controlled in that the magnet valve 34 is switched on correspondingly below 180 rotation of the camshaft. At lower rpm, contrarily, a control above 180 rotation of the camshaft could theoretically still have an effect, except that just then it is unnecessary. In the range up to 3000 rpm, the closure of the inlet valve normally occurs at 180 rotation of the camshaft, in order to maintain the maximum power yield necessary there. In diagram a, this corresponds to a switchover of the magnet valve 34 at approximately 160 rotation of the camshaft, at 3000 rpm corresponding to diagram b, it corresponds to that at 130 rotation of the camshaft.

Figure 4:
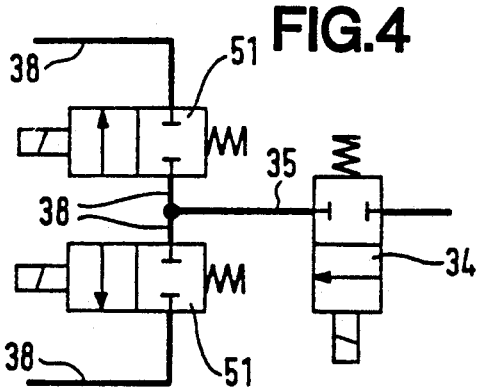
FIG. 4 and FIG. 5 show two variants of the hydraulic circuit diagram of FIG. 1.

In multi-cylinder internal combustion engines, it is known that a plurality of explosion strokes occur per crankshaft revolution, for instance two such explosion strokes for a 4-cylinder engine. Thus in a 4-cylinder engine, the four explosion strokes of the four cylinders take place within two revolutions. A typical ignition sequence is three-four-two-one, for example, in terms of the side-by-side engine cylinders. Since as shown in FIG. 3, opening of a engine valve can proceed beyond 240 rotation of the camshaft, the result is an overlap from 180 rotation of the camshaft on each time. As long as the various engine valves are controlled independently of one another, this plays no role. However, in a feature of the invention, a plurality of engine valves are intended to be controlled with only one magnet valve 34. Because as noted above the range above 180 rotation of the camshaft is unimportant for the control, the control is designed according to the invention such that the magnet valve 34 is opened only up to 180 rotation of the camshaft. As a result it is theoretically possible to control all four engine cylinders with only one magnet valve, by opening the magnet valve at least twice per revolution, and with only the reservoir valve 22 at the associated engine valve of which the cam 4 is just then operative lifting from its seat 25. Since no control is necessary in the remaining range from 180° to 240° rotation of the camshaft, an overlap can not even occur. In some engines, which have a higher number of cylinders or a larger inlet closure angle after bottom dead center of the engine valve, it is useful to switch two engine valve control units, in a four-cylinder engine, each via one magnet valve. Thus in the variant in FIG. 4, with the magnet valve 34 and corresponding branching of the control line 35, there is one 2/2-way magnet valve 51 each disposed in each of the two control lines 38, and downstream of these magnet valves 51, the control lines 38 branch again, and lead to the various engine valve control units.

Figure 5:
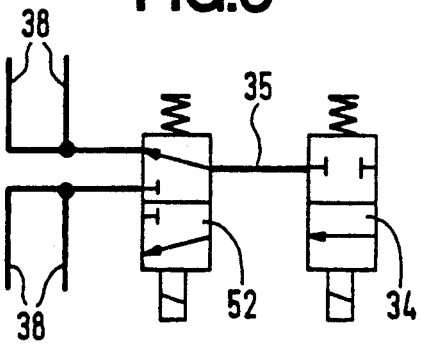

In FIG. 5, the control line 35 of the magnet valve 34 discharges into the inlet of a 3/2-way magnet valve 52, the outlets of which lead in turn to the control lines 38, which then branch again and lead to the various engine valve control units.

Figure 6:
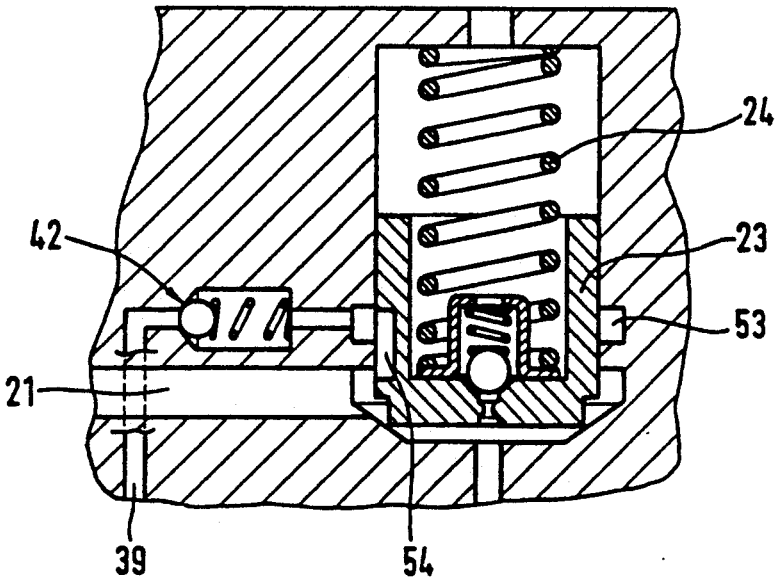
FIG. 6 shows a variant of the reservoir piston control, in a corresponding and enlarged detail from FIG. 1.

FIG. 6 shows a variant for controlling the filling line 39; the discharge of the filling line 39 is effected downstream of the one way check valve 42 by means of the reservoir piston 23. To this end, the filling line 39 discharges into an annular groove 53 in the wall of the bore in which the reservoir piston 23 is radially sealingly guided; this annular groove 53 communicates with the pressure conduit 21 via a longitudinal groove 54 of limited length, in the position of repose, of the reservoir piston 23. As a result, in this position of repose of the reservoir piston 23, unhindered filling of the pressure conduit 21 and thus of the pressure chamber can take place. As soon as the reservoir piston 23 has been lifted from its seat, the longitudinal groove 54 is separated from the pressure conduit 21 by the displacement of the reservoir piston 23, so that in this kind of displaced position no hydraulic oil from the filling line 39 can reach the pressure conduit 21. This makes for finer adjustment of the pressure balance in the control system so that even at high rpm and at a correspondingly lower working pressure, no defective control resulting from undesired opening of the reservoir valve 22 occurs. The force that engages the reservoir piston 23 by means of the reservoir spring 24 can then be lower than the force acting upon the reservoir piston 23 in the opening direction, the latter being effected by the pilot pressure when it acts upon the entire end face. However, as soon as the reservoir piston 23 rests on the seat 25, the only pressure that can be established in the reservoir chamber 26 is the pressure determined by the relief valve 46, which in any case is substantially lower than the control pressure or the constant pilot pressure in the pressure conduit 21. Naturally, this situation changes if the magnet valve 34 is switched over and hydraulic oil flows at control pressure into the reservoir chamber 26 via the control line 35 and lifts the reservoir piston 23 from its seat 25, so that once again the entire end face can be acted upon by working pressure.

All the characteristics in the specification, the ensuing claims, and shown in the drawing may be essential to the invention either individually or in any arbitrary combination with one another.

We claim:

1. A hydraulic valve control apparatus for internal combustion engines, comprising:

an engine valve axially driven by a drive cam of an engine camshaft via a valve tappet, a pressure chamber (19) of variable volume determining an effective length of the valve tappet, a fluid reservoir (22) connectable with the pressure chamber via a pressure conduit (21) and said fluid reservoir having a spring-loaded reservoir piston (23) that on its face end defines a reservoir chamber (26), a magnet valve (34) that is triggered via an electronic control unit that processes engine parameters for controlling fluid flow to said fluid reservoir, said reservoir piston (23), as a movable element, controls a connection between said pressure conduit (21) and the reservoir chamber (26), said reservoir piston is engaged by a reservoir spring (24) and biased to a position closing said pressure conduit connection to said fluid reservoir, the reservoir piston (23) having a pressure shoulder (43) acting counter to the force of the reservoir spring (24) and always acted upon by the pressure in the pressure conduit (21) is present on a control line (35) including a one-way check valve (36) that opens in a direction toward the reservoir chamber (26) for controlling said fluid at a predetermined control pressure that discharges into the reservoir chamber (26), the control line being controlled by said magnet valve (34), and a spring force engaging the reservoir piston (23) by means of the reservoir spring (24) is greater than a control force engaging the reservoir piston (23) as a result of the control pressure but less than an actuation force that is produced whenever an end face of the reservoir piston (23) is exposed to a working pressure of the pressure chamber when the valve tappet is actuated by the drive cam (4) in an opening direction.

2. A valve control apparatus as defined by claim 1, in which the force of the reservoir spring (24) is greater than the control force plus a pilot pressure force of said pressure in the pressure chamber before said valve tappet is actuated by the drive cam effected by the pressure shoulder (43).

3. A valve control apparatus as defined by claim 1, in which a relief line (47) that contains a backup throttle branches off from the reservoir chamber.

4. A valve control apparatus as defined by claim 2, in which a relief line (47) that contains a backup throttle branches off from the reservoir chamber.

5. A valve control apparatus as defined by claim 3, in which the relief line (47) is controlled by a pressure holding valve (46).

6. A valve control apparatus as defined by claim 4, in which the relief line (47) is controlled by a pressure holding valve (46).

7. A valve control apparatus as defined by claim 3, in which the relief line (47) is disposed in a bottom of the reservoir piston (23) and connects the reservoir chamber (24) to the reservoir spring chamber (48).

8. A valve control apparatus as defined by claim 5, in which the relief line (47) is disposed in a bottom of the reservoir piston (23) and connects the reservoir chamber (24) to the reservoir spring chamber (48).

9. A valve control apparatus as defined by claim 1, in which a pilot pressure reservoir (37) is connected, upstream of the magnet valve (34), to a feed line (31) for the control fluid.

10. A valve control apparatus as defined by claim 2, in which a pilot pressure reservoir (37) is connected, upstream of the magnet valve (34), to a feed line (31) for the control fluid.

11. A valve control apparatus as defined by claim 3, in which a pilot pressure reservoir (37) is connected, upstream of the magnet valve (34), to a feed line (31) for the control fluid.

12. A valve control apparatus as defined by claim 5, in which a pilot pressure reservoir (37) is connected, upstream of the magnet valve (34), to a feed line (31) for the control fluid.

13. A valve control apparatus as defined by claim 7, in which a pilot pressure reservoir (37) is connected, upstream of the magnet valve (34), to a feed line (31) for the control fluid.

14. A valve control apparatus as defined by claim 1, in which the magnet valve (34) is embodied as a 2/2-way magnet valve.

15. A valve control apparatus as defined by claim 2, in which the magnet valve (34) is embodied as a 2/2-way magnet valve.

16. A valve control apparatus as defined by claim 3, in which the magnet valve (34) is embodied as a 2/2-way magnet valve.

17. A valve control apparatus as defined by claim 5, in which the magnet valve (34) is embodied as a 2/2-way magnet valve.

18. A valve control apparatus as defined by claim 7, in which the magnet valve (34) is embodied as a 2/2-way magnet valve.

19. A valve control apparatus as defined by claim 9, in which the magnet valve (34) is embodied as a 2/2-way magnet valve.

20. A valve control apparatus as defined by claim 19, in which the force of the reservoir spring (24) is less than an opening force embodied by a sum of the control pressure and a fluid pressure created by the drive cam on the pressure shoulder (43) of the reservoir piston, and that a filling line (39) is controlled by the reservoir piston (23), wherein after the connection between the pressure conduit (21) and reservoir chamber (26) is established, the filling line (39) is blocked.

21. A valve control apparatus as defined by claim 20, in which on a jacket face of the reservoir piston (23) there is a longitudinal groove (54), which is in constant communication with an annular groove (53) present in a bore receiving the reservoir piston (23) and which in a position of repose communicates with the pressure conduit (21), but is separated from the pressure conduit (21) after the reservoir piston (23) is displaced counter to the force of the reservoir spring (24).

22. A valve control apparatus as defined by claim 1, in which the pressure conduit (21) communicates via a filling line (39) with a supply line (31) that is under a second control pressure, and that a check valve (41) opening in the direction of the pressure conduit (21) is disposed in the filling line (39).

23. A valve control apparatus, as defined by claim 1, for a multi-cylinder internal combustion engine, in which via an electronic control unit, various valve control units are each controllable only up to a drive of 180° of crankshaft rotation angle, so that a plurality of valve control units are controlled by only one magnet valve (34), and overlapping of control times.

24. A valve control apparatus as defined by claim 23, in which groups of valve control units, after a first division of the control line downstream of the magnet valve (34), are controllable by at least one preselection valve (51, 52).

25. A valve control apparatus as defined by claim 24, in which the preselection valve is embodied as a 2/2-way valve (51).

26. A valve control apparatus as defined by claim 24, in which a 3/2-way valve simultaneously effecting a division serves as the preselection valve.

* * * * *